US007553240B2

(12) United States Patent
Burnett et al.

(10) Patent No.: US 7,553,240 B2
(45) Date of Patent: Jun. 30, 2009

(54) GOLF CLUB HEADS WITH INTERCHANGEABLE HOSELS

(75) Inventors: Michael Scott Burnett, Carlsbad, CA (US); Daniel S. Callinan, Carlsbad, CA (US); Christopher D. Harvell, Escondido, CA (US); Jeffrey W. Meyer, Fallbrook, CA (US); Stephen S. Murphy, Carlsbad, CA (US); David A. Shear, BelleVernon, PA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/621,754

(22) Filed: Jan. 10, 2007

(65) Prior Publication Data

US 2008/0167137 A1 Jul. 10, 2008

(51) Int. Cl.
*A63B 53/02* (2006.01)

(52) U.S. Cl. ..... 473/288; 473/307; 473/309

(58) Field of Classification Search ..... 473/287–288, 473/296, 298–299, 308–311, 305–306, 307
See application file for complete search history.

(56) References Cited

U.S. PATENT DOCUMENTS

| | | | | |
|---|---|---|---|---|
| 5,028,191 | A | 7/1991 | Rowley et al. | |
| 5,513,844 | A * | 5/1996 | Ashcraft et al. | 473/288 |
| 5,527,034 | A * | 6/1996 | Ashcraft et al. | 473/330 |
| 5,851,155 | A | 12/1998 | Wood et al. | |
| 5,951,411 | A | 9/1999 | Wood et al. | |
| 6,431,993 | B1 | 8/2002 | Dyer | |
| 6,752,726 | B2 | 6/2004 | Burrows | |
| 6,769,994 | B2 | 8/2004 | Boone | |
| 2005/0282653 | A1 | 12/2005 | Murphy et al. | |

OTHER PUBLICATIONS

"Self-locking fastener" Lewis, John. *Design News*. Apr. 22, 2002. at http://www.designnews.com/article/CA208964.html.

* cited by examiner

*Primary Examiner*—Stephen L. Blau
(74) *Attorney, Agent, or Firm*—Kristin D. Wheeler

(57) ABSTRACT

A hosel set for a golf club is provided that contains a plurality of hosels that can be used interchangeably and removably with one or more golf club heads to secure a shaft to the golf club heads. The hosels vary in length while maintaining the same weight. Mating, curved surfaces are provided on the hosel and the golf club head to facilitate ease of bending and to reduce binding and gapping between the hosel and the golf club head.

14 Claims, 9 Drawing Sheets

GOLF CLUB HEADS WITH INTERCHANGEABLE HOSELS

FIELD OF THE INVENTION

The present invention relates to golf clubs. In particular, the present invention relates to improved hosels for golf club heads.

BACKGROUND OF THE INVENTION

In general, a golf club, either an iron-style or wood-style club, includes a golf club head that is attached to a shaft through a hosel disposed at or near the heel of the golf club head. The hosel is normally formed integral with a cast club head of the iron or so-called metal wood type to extend generally upwardly at an appropriate angle from the heel end of the golf club head. The hosel is suitably cast or machined to define an open-ended and generally cylindrical, upwardly open hosel bore.

In order to provide improved characteristics in the golf club head such as increasing the overall size of the club head, expanding the sweet spot, enhancing the moment of inertia and optimizing the club head center of gravity location, modifications have been made to the hosel portion of golf clubs. Certain golf club arrangements use inserts or other structures in conjunction with the hosel to change properties of the golf club.

For example, U.S. Pat. No. 6,431,993 is directed to a hosel interface that is inserted in a hosel that has been formed integral with a club head. The hosel interface includes various sections including an insertable section that is inserted into the hosel, a shaft receptacle opposite the insertable section for receiving the shaft and an integral bendable section between the shaft receptacle and the insertable section. An exterior shoulder is provided between the bendable section and the insertable section, and the bendable section is bent to alter the angle between the club head and the shaft. Although the hosel interface provides for a degree of adjustment of the angle between the shaft and the club head, the hosel is still formed integrally with the club head and the hosel interface is a separate structure that adds additional weight to the club that could adversely affect the moment of inertia (MOI) and center of gravity of the golf club. In addition, the shaft does not extent into the hosel, creating a potentially weakened area adjacent the club head that could lead to increased and undesirable flex at the shaft and club head interface.

Other attempts at varying the angles between the shaft and the club head utilize interchangeable hosels. For example, U.S. Pat. No. 6,769,994 is directed to interchangeable hosels for golf clubs to customize the golf club for the purposes of shot control. A plurality of hosels is provided, and each hosel contains a shaft receiving opening. The angle and direction at which the opening extends from a pivot point is adjusted to customize the golf club assembly for each individual golfer. Therefore, each one of the plurality of hosels offers a different longitudinal angle, such as the face angle, and a different lie angle. The hosel is securely retained within a bore in the golf club head using suitable adhesives. However, the hosels are relatively large and heavy structures that add weight to the heel of the club. In addition, each hosel represents a single, distinct angle that cannot be changed once the hosel is inserted. Moreover, the hosel is attached using adhesives, which makes the replacement of the existing hosel more difficult.

U.S. Pat. Nos. 5,851,155 and 5,951,411 are directed to golf clubs having interchangeable shafts and interchangeable hosels. The hosel includes a plug member that is received within an opening in the heel of the club head. The plug member includes a threaded opening for receiving a screw to secure the hosel to the club head. The hosel is selected to provide a desired club lie angle and club face angle. Again, the hosel represents a large structure that adds significant weight to the heel end of the club head. In addition, each hosel represents a single, distinct shaft angle. Therefore, a large number of hosels will be required to provide for significant variety in shaft angles.

Since the hosel presents a substantial off-center mass located at the heel end of the club head, attempts to optimize balanced weighting of the club head with hosel arrangements have been developed to decrease the effects of the hosel on the overall weighting of the golf club head. For example in commonly owned, co-pending U.S. Patent Application Publication No. 2005/0282653, a golf club is disclosed that includes a club head having a passage there through from the crown to the sole in proximity to the heel. A separate bore-through hosel insert is retained within this passage and retained therein in known fashion, such as by adhesives. The shaft is positioned and retained within the bore-through hosel insert. To better control the club head center of gravity and moment of inertia, the bore-through hosel insert has a low mass. However, the bore-through hosel does not provide for adjustments to the angle between the shaft and the club head. In addition, by being attached using adhesives, the hosel does not provide for ease of removal or interchangeability with other hosels.

Existing attempts at providing for modifications to a golf club head typically focus on changes to a single factor, e.g. weight or shaft angle, while ignoring other factors. For example, adjustments to the hosel of a golf club are made to provide for adjustments in the angle between club head and the shaft while adversely affecting the weight balance in the club head. Other examples provide for light weight hosels but not for interchangeable hosels. There remains a need for a hosel that provides easy interchangeability of both the hosel and the shaft and adjustments to the angle between the club head and the shaft through bending without adversely affecting the structure or looks of the golf club. In addition, an interchangeable hosel is desired that provides for adjustments to the flex or stiffness at the end of the shaft without changing the weight characteristics of the golf club.

SUMMARY OF THE INVENTION

The present invention is directed to golf clubs having golf club heads and interchangeable, removable and adjustable hosels for attaching shafts to the golf club heads. In one embodiment, a plurality of hosels is provided that can be used interchangeably in the golf club heads. Each hosel has substantially the same weight but a different length and construction. The varying lengths of the hosel affect the stiffness of the interface between the club head and the shaft, thereby changing the launch conditions of the club. For example, a relatively short hosel can be swapped with a relatively long hosel in order to change the flexure of the tip-end of the shaft both before and during impact between the club head and a golf ball, thereby changing the launch conditions of the club head.

In one embodiment, a hosel set containing a plurality of hosels is provided, wherein each hosel may have different materials, constructions, thicknesses and arrangements while maintaining substantially equivalent weights. These hosels are used in conjunction with a set of golf club heads, both iron-type and wood-type golf club heads. Any one of the hosels in the hosel set can be selected and inserted into a given golf club head to achieve the desired golf club characteristics.

Interchangeable hosels allow the club maker to change and to customize the lie angle, face angle, and cosmetic look of the club head, for both performance and aesthetic reasons.

In one embodiment, the interchangeable hosel is removably attached to the club head, for example using a two-parts mechanical fastener such as corresponding male and female threads. The threads are disposed within the passage on the club head to which the hosel is secured and mate with corresponding threads that are provided on an exterior diameter of each one of the interchangeable hosels. Therefore, a hosel can be removed as desired and a replacement hosel from the hosel set having a different characteristic such as length or angle can be substituted without adversely affecting the weighting characteristics of the golf club. By maintaining substantially the same weight from hosel to hosel, the moment of inertia (MOI) and center of gravity of the club head is not significantly affected by changes in other hosel characteristics. In addition, the threaded removable hosel improves the ease with which the golf club is re-shafted, since the hosel and shaft can be unscrewed from the club head to provide for easier removal of the hosel from the shaft. In one embodiment, the threads that provide for the insertion and removal of the hosels may contain a locking mechanism.

In one embodiment, the hosel is bendable to provide for adjustments to the angle between the club head and the shaft after the hosel has been inserted into the golf club head. In addition, the hosel and club head are shaped to facilitate bending without causing binding between the hosel and the club head or creating undesirable gaps between the club head and the hosel. The hosel and the club head in the vicinity of the cavity into which the hosel is inserted have complimentary, generally rounded shapes, for example a ball and socket type interface. As the hosel is bent, the complimentary surfaces move with respect to each other without causing gaping or binding.

DETAILED DESCRIPTION

Figure 1:
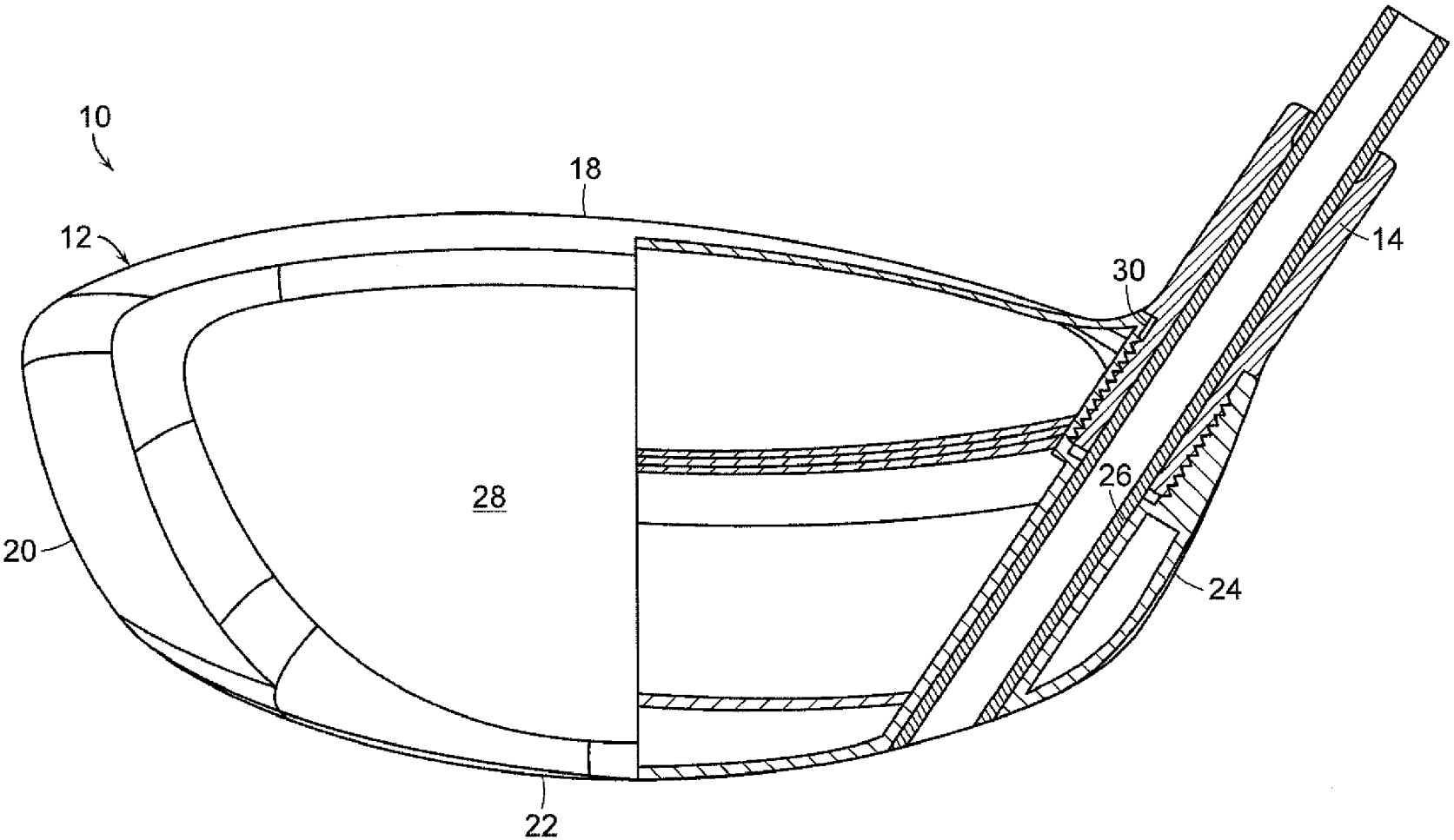
FIG. 1 is a partial cut-away front view of an embodiment of a golf club head and hosel set in accordance with the present invention.

Referring initially to FIG. 1, an exemplary embodiment of a golf club 10 in accordance with the present invention illustrated. Golf club 10 includes golf club head 12. Golf club head can be either an iron-type club head or a wood-type club head. As illustrated, golf club head 12 is a metal wood-type golf club head. Golf club head 12 includes toe 20, heel 24 opposite toe 20, sole 22, crown 18 opposite sole 22 and club face 28 for impacting golf balls. Golf club head 12 also includes cavity 26 disposed adjacent heel 24 and running generally from crown 18 to sole 22. As illustrated, cavity 26 runs completely through golf club head 12 from crown 18 to sole 22. Alternatively, cavity 26 only runs partially through golf club head 12. Cavity 26 includes opening 30 disposed on crown 18. Golf club 10 also includes hosel 14 disposed within cavity 26. Opening 30 is sized to accommodate passage of hosel 14 into cavity 26. Hosel 14 is preferably a hollow tube or cylinder to accommodate insertion and attachment of shaft 16. Shaft 16 is inserted through the central opening in hosel 14 and can be secured therein using, for example, adhesives.

In accordance with one embodiment, hosel 14 is part of a hosel set that includes two or more interchangeable and removable hosels. Various properties of the hosels are varied while holding other properties constant to facilitate changes in one aspect or characteristic of the golf club while not affecting others. For example, the length of the hosel can be varied without changing significantly the weight of the hosel and hence to overall weight of the golf club and the location of the MOI and center of gravity. In one embodiment, the hosel set includes at least two hosels. Each hosel has a different or unique length and substantially the same weight as any other hosel in the hosel set. In addition, each hosel is arranged to fit within the same given cavity within the golf club head. Therefore, each hosel can be used interchangeably with the other hosels to attach a shaft to the golf club head. Suitable lengths for each hosel include, but are not limited to, from about 0.5 inch to about 8 inches.

Figure 2:
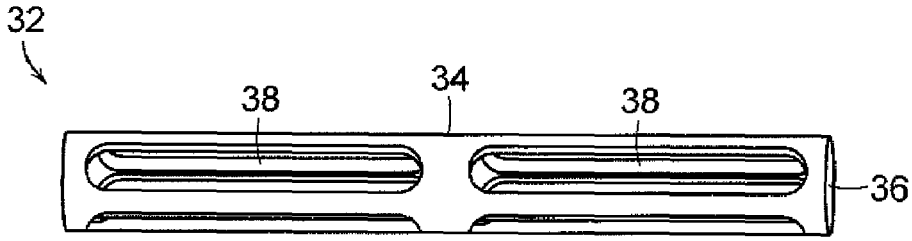
FIG. 2 is a perspective view of an embodiment of an interchangeable hosel of the present invention.
Figure 3:
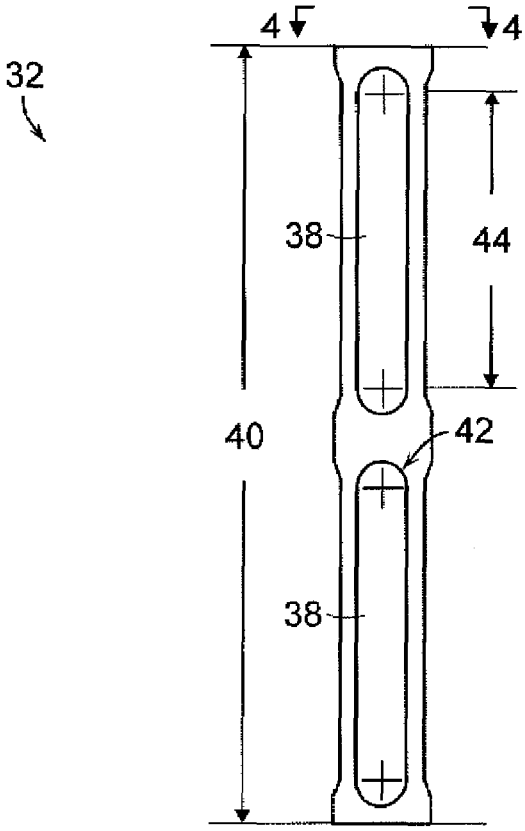
FIG. 3 is a side view of the hosel of FIG. 2.
Figure 4:
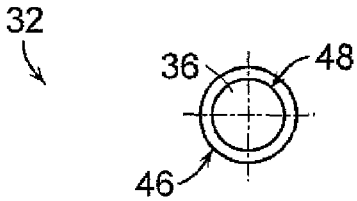
FIG. 4 is a view through line 4-4 of FIG. 3.
Figure 5:
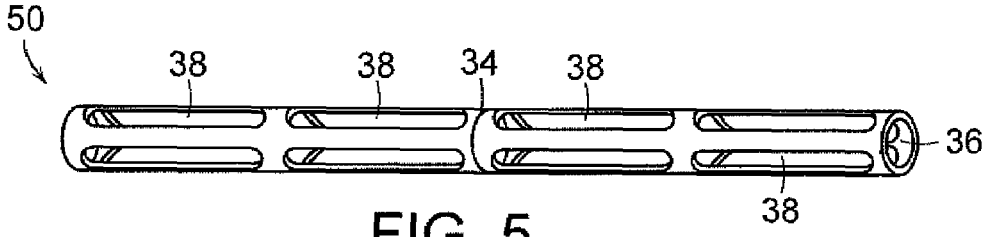
FIG. 5 is a perspective view of another embodiment of an interchangeable hosel of the present invention.
Figure 6:
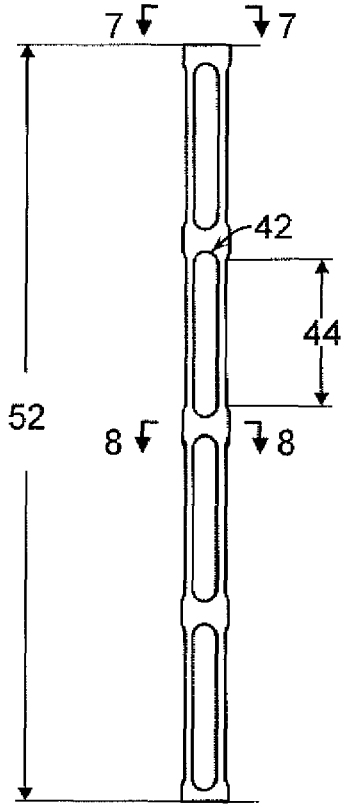
FIG. 6 is a side view of the hosel of FIG. 5.

Referring to FIGS. 2-4, an exemplary embodiment of a hosel 32 is illustrated. Hosel 32 is arranged as a hollow tube having side walls 34 and a central bore 36 sized to accommodate shaft 16. As is best shown in FIG. 4, central bore 36 has inner diameter 48 and hosel 32 has outer diameter 46. In one embodiment, diameter 48 is about 0.37 inches, and diameter 46 is about 0.5 inches. Although the side walls 34 can be substantially solid, in one embodiment side walls 34 contain one or more holes 38. As illustrated, side walls 34 of hosel 32 contain a plurality of holes 38. Holes 38 are arranged to reduce the weight of hosel 32 while still providing the desired amount of structure, support or stiffness. Any number of holes 38 can be provided in any suitable shape. Holes 38 can all be the same size and shape or can be varied in size and shape. In one embodiment as illustrated, each hole 38 is an elongated, rounded slot having length 44 with rounded ends having radius 42. In one embodiment, length 44 is about 1.5 inches, and radius 42 is about 0.125 inches.

Hosel 32 has overall length 40. In one embodiment, overall length 40 is about 4 inches. Overall length 40 is selected based upon the depth of cavity 26 and the length of shaft 16 to be covered by the hosel. In general, the unique length of each hosel in the hosel set causes the shaft to exhibit an associated unique shaft flexure during the swing of the club and at impact between the golf club and a golf ball. Therefore, longer hosels produce stiffer shaft section(s) at the interface between the shaft and the club head. However, each hosel is substantially the same weight; therefore, shaft stiffness can be modified for the same shaft and club head without changing significantly the weight characteristics of the golf club. As show in FIGS. 5-8, another hosel 50 that is part of the hosel set is illustrated. Hosel 50 is also arranged as a hollow tube having central bore 36 to accommodate a shaft. Hosel has a plurality of holes 38 in side walls 34. Holes 38 are also arranged as elongated rounded slots having length 44 and end radius 42. Again, slot length is about 1.5 inches and radius 42 is about 0.125 inches. Hosel 50 has overall length 52, which in one embodiment is about 8 inches. However, hosel 50 is substantially the same weight as hosel 32. In one embodiment this is accomplished by having an increased number or size of holes in the side walls. In addition, the amount of material, i.e., the thickness of the side walls, or the type of material can be varied to control the weight of the hosel.

Holes 38 are designed to alter the flexibility of the hosel and the shaft once inserted into the hosel. Holes 38 also remove the weight from the hosel and to reposition the weight to another part of the golf club to improve its mass distribution and placement of the center of gravity, e.g., lowering the center of gravity and moving it aft. It has been determined that up to 13.3 grams of weight can be repositioned to the sole plate by using holes 38. A comparative club with an all titanium hosel of similar shape and size can only be repositioned about 5.5 grams of weight to the sole plate. The improved location of the center of gravity is shown below.

| Club Tested | CGy-g | ΔCGy-g | CG-C | ΔCGz-fc |
|---|---|---|---|---|
| 463 cc driver with a hosel with holes 38 | 1.048 in | 0.048 in lower | 0.713 in | 0.40 in aft |
| 461 cc driver with a solid hosel | 1.096 in | | 0.673 in | |

where CGy-g is the center of gravity relative to the ground in the vertical or y-direction and CG-C is the center of gravity relative to the shaft axis in the z-direction.

Figure 7:
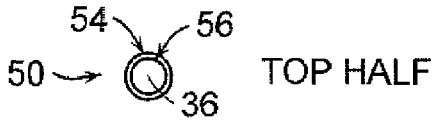
FIG. 7 is a view though line 7-7 of FIG. 6.
Figure 8:
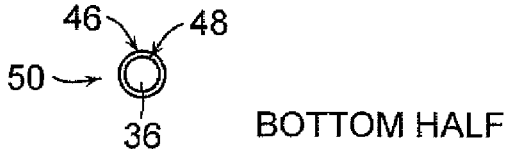
FIG. 8 is a view through line 8-8 of FIG. 6.

As illustrated in FIG. 8, the bottom half of hosel 50 has side wall or outer diameter 46 and bore or inner diameter 48. In one embodiment, side wall/outer diameter 46 is about 0.5 inches, and bore/inner diameter 48 is about 0.37 inches. As illustrated in FIG. 7, the top half of hosel 50 has side wall/outer diameter 54 and central bore/inner diameter 56. In one embodiment, side wall diameter 54 is about 0.5 inches and bore diameter 56 is about 0.4 inches. Therefore, the thickness of the side walls in the top half are thinner and hence weigh less. In addition to decreasing the overall weight of hosel 50, the weight of hosel 50 is centered toward the bottom half. The thickness of the side walls can be constant or varying, and can have any profile to vary the weight distribution and flexural distribution of the hosels.

Golf clubs utilizing the hosel set of the present invention were tested with 4 inch and 8 inch hosels, no hosel and a 4 inch hosel that was not securely attached to the golf club head. A single golf club head attached to a shaft using each one of the four hosel set-ups was attached to a mechanized robotic arm to produce center face impacts on golf balls and to measure various properties of the golf ball at swing speeds ranging from 82 mph to 117 mph.

Figure 12:
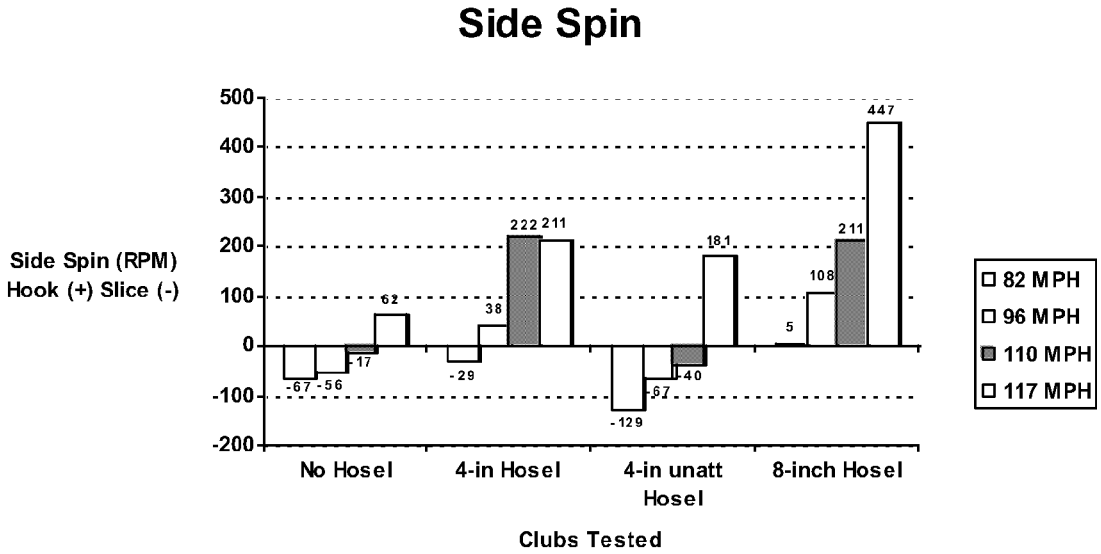
FIG. 12 is a graph depicting side spin for the tested clubs at various swing speeds.

FIG. 12 shows the effects of hosel and swing speed on the side spin imparted on the impacted golf balls. Side spin is imparted on the golf ball by the strike face as a result of the angle between the strike face and the golf ball at the point of impact. A positive side spin indicates a "closed" club face and corresponds to a hook, i.e., a ball that travels to the left for right-handed golfers. Conversely, a negative side spin indicates an "open" club face and corresponds to a slice, i.e., a ball that travels to the right for right-handed golfers. For a given set-up, that is a given strike angle, increased flex in the joint between the shaft and the golf club head results in an decreasing hook or increasing slice, i.e. the club face will open. This is shown in FIG. 12 by the increase in side spin from no hosel to 4 inch hosel to 8 inch hosel. An unattached 4 inch hosel allows more flex than the attached 4 inch hosel. Also, the amount of flex decreases with swing speed.

Figure 13:
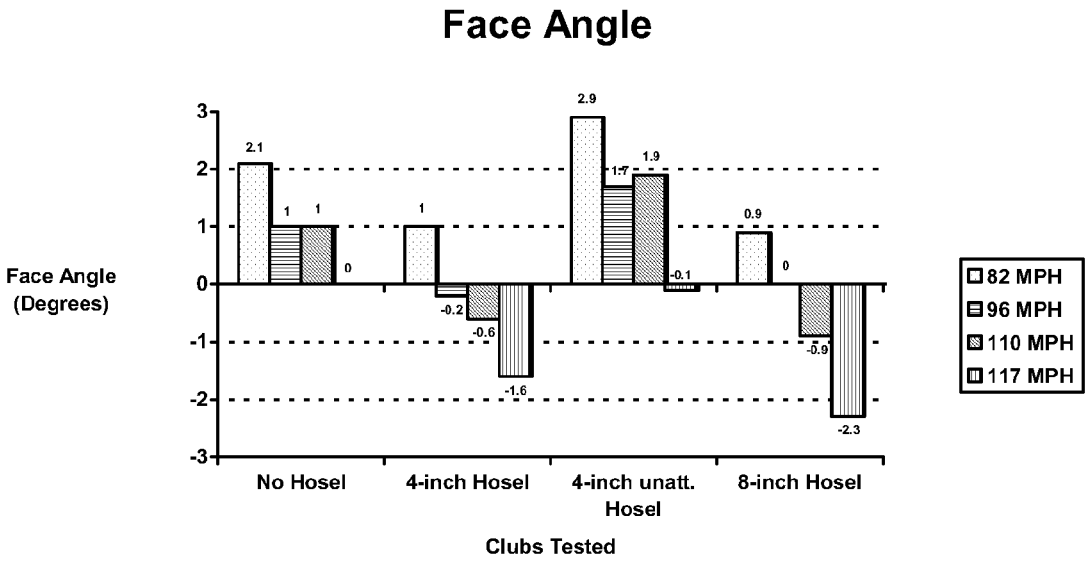
FIG. 13 is a graph depicting face angle for the tested clubs at various swing speeds.

FIG. 13 shows the correlation of side spin to face angle under the same testing conditions. Face angle is the angle of a wood-type club to the sole line with the shaft bore positioned perpendicular to the target, or the position of the club face relative to the intended line of the ball's flight. A square face aligns directly at the target. For right handed golfers, an open face aligns to the right of target and a closed face aligns left. An open face typically produces slice shots and a closed face typically produces hook shots. As shown in FIG. 13, a proper selection of hosel in accordance with the present invention can introduce either a hook or a spin to the player's spin to compensate for a particular swing habit. Increased side spin relates to a closed face and a more negative face angle. Conversely, a decreased side spin relates to a more open face and a larger face angle.

Figure 14:
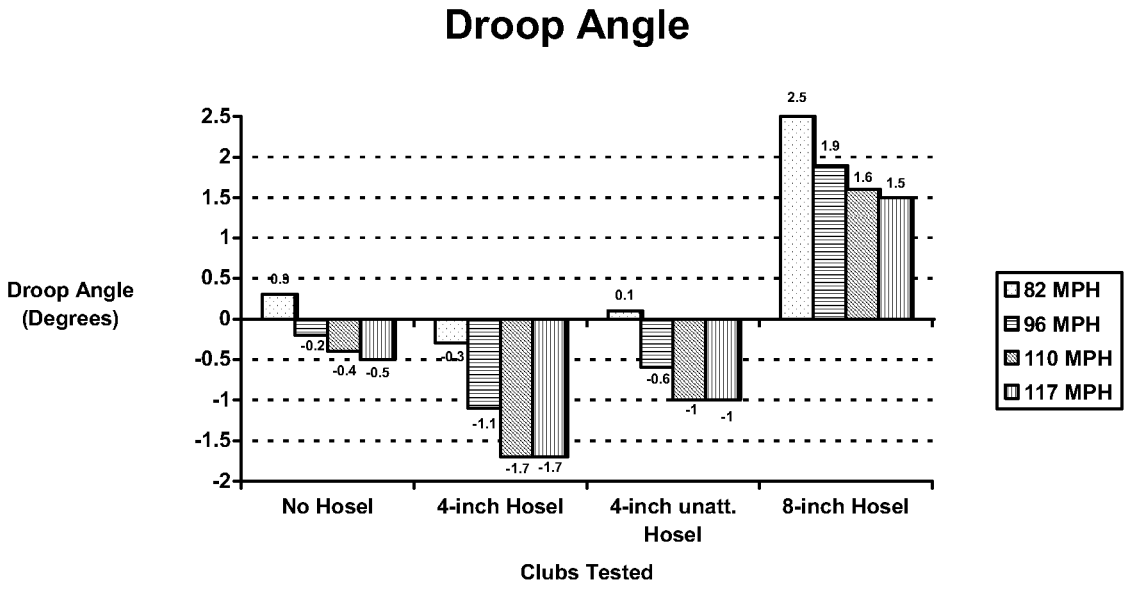
FIG. 14 is a graph depicting droop angle for the tested clubs at various swing speeds.

FIG. 14 illustrates the effect of hosel length on droop angle. Since the club head represents a mass that is not aligned with the center of the shaft, the centrifugal force generated by the swinging of the golf club will push this mass to align with the shaft. In particular, centrifugal force will urge the toe of the club to pivot in the direction of the sole, i.e., to droop. Increased stiffness in the joint between the shaft and the club face decreases droop and increases droop angle. Increased flex, increases droop and decreases droop angle. FIG. 14 shows decreased droop for increased hosel length.

Figure 15:
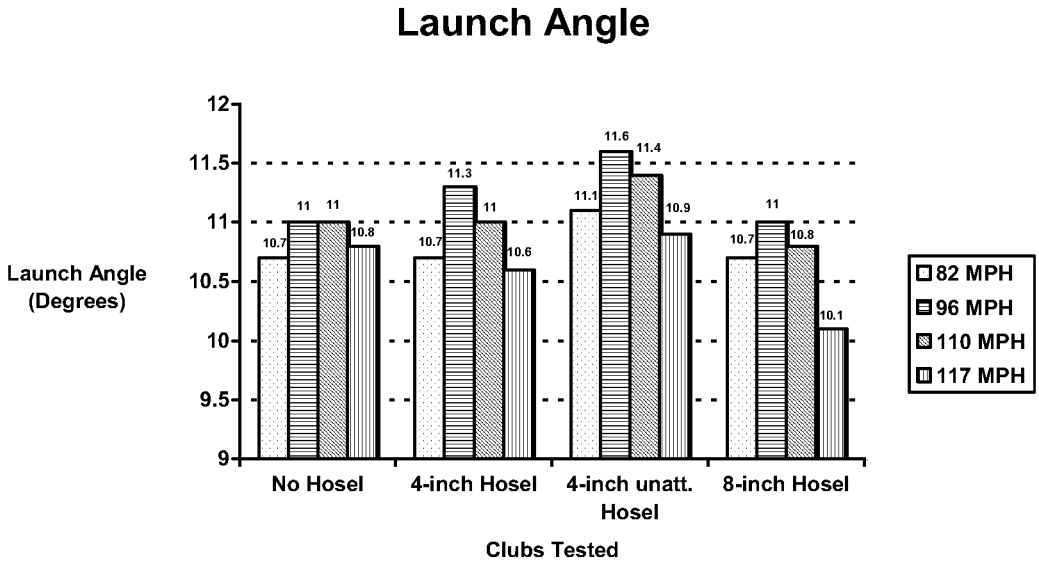
FIG. 15 is a graph depicting launch angle for the tested clubs at various swing speeds.
Figure 16:
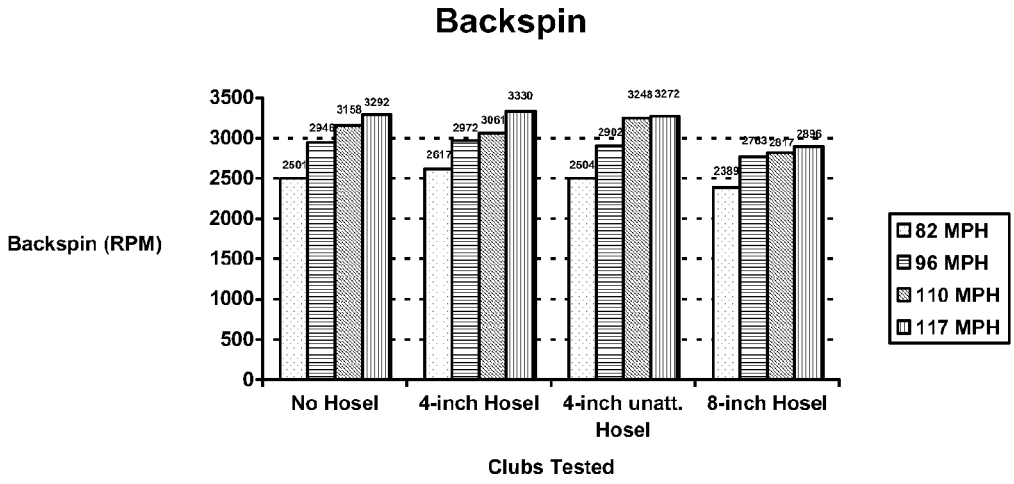
FIG. 16 is a graph depicting backspin for the tested clubs at various swing speeds.

In addition to the club head drooping or pivoting from heel to town, the club head can also pivot from sole to crown. Increased pivot, that is the crown pivoting backwards with respect to the sole and the swing direction, results in an increased launch angle and resulted back spin on the golf ball. Longer shafts generally display lower launch angles and back spin, although the changes are not as pronounced as for side spin or drop. In addition, a four inch hosel and unattached hosel show a slight increase in launch angle over no hosel, and the eight inch hosel shows a decrease in launch angle at higher swing speed. This is illustrated in FIGS. 15 and 16.

Figure 17:
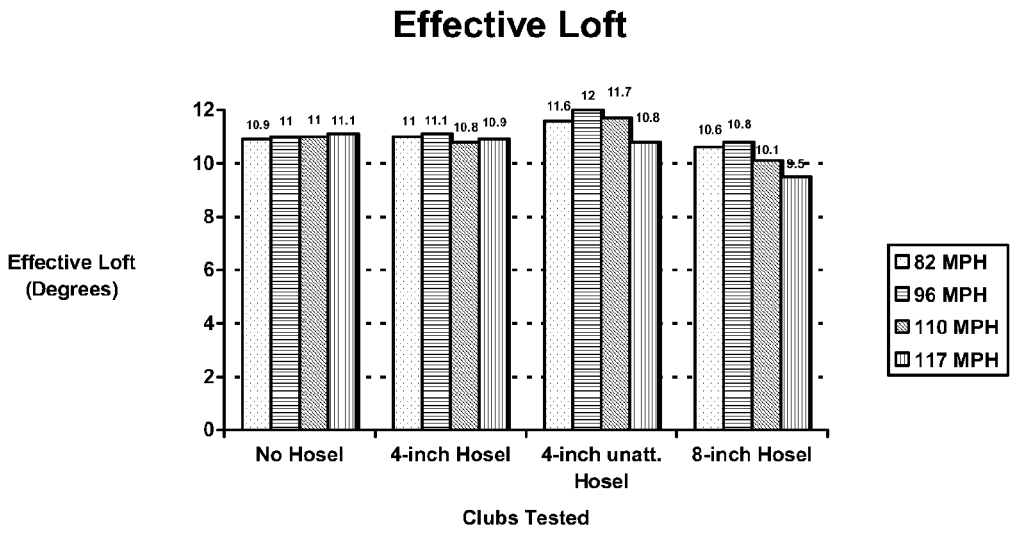
FIG. 17 is a graph depicting effective loft for the tested clubs at various swing speeds.

The launch angle and back spin data are in agreement with the effective loft angle shown in FIG. 17. The eight-inch hosel, due to its longer length and greater stiffness, has a lower effective loft angle at impact. This translates to lower launch angle, as shown in FIG. 15, and lower spin, as shown in FIG. 16.

Figure 9:
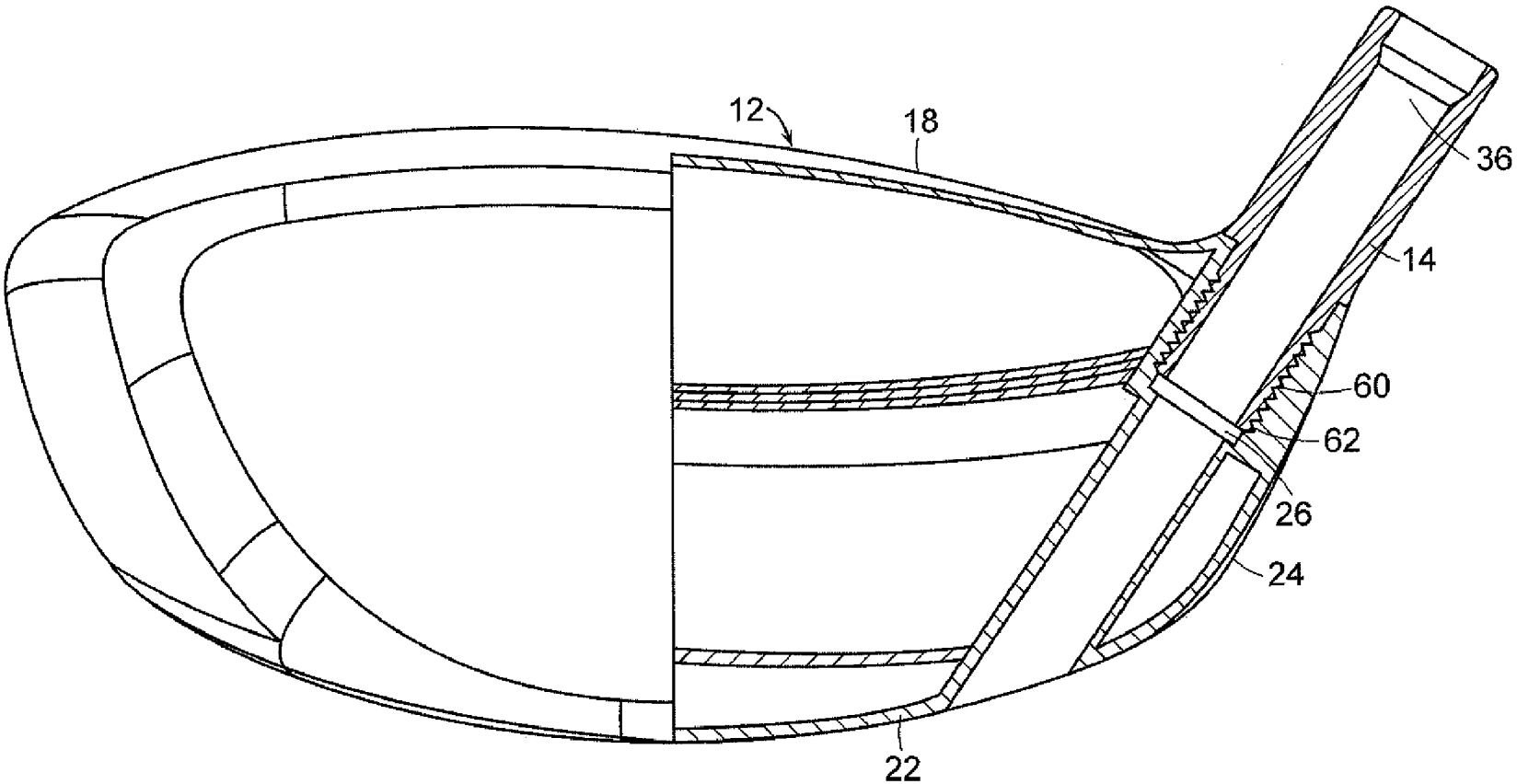
FIG. 9 is a cross-sectional view of an embodiment of a removable hosel of the present invention.

In addition to being interchangeable, exemplary embodiments of hosels in accordance with the present invention can also be removable. Although in one embodiment, a given hosel is secured in the cavity of the golf club head using an adhesive disposed in the cavity, each hosel is preferably releasably or removably secured in the cavity using an appropriate type of fastener. In one embodiment, the cavity contains a first part of a two-part mechanical fastener, and each one of the hosels comprises a complimentary second part of the two-part mechanical fastener. As illustrated in FIG. 9, the two-part mechanical fastener is a threaded fastener, and the cavity contains first set of threads 60. As illustrated, first set of threads 60 are generally female threads lining a portion of the interior of cavity 26. Each hosel 14 is arranged as a hollow tube, and the second part of the two-part fastener is a complimentary second set of threads 62 disposed on an exterior surface of the hollow tube, i.e. the male threads. In one embodiment, each hosel has substantially the same set of male threads. The exact arrangement of the threads, e.g. the coarseness, can be varied as desired.

In one embodiment, the threads alone are used to secure the hosel in the cavity, and secure attachment is provided through adequate tightening of the threads. Alternatively, a self-locking mechanism (not shown) is provided in conjunction with the threaded cavity and threaded hosel to secure the hosel in the cavity and to minimize loosening of the threaded connection. In one embodiment, the locking mechanism includes locking pins that run longitudinally through the threads. The threads have a locking pin that runs longitudinally through the threads. Such locking mechanism for threaded connectors is described in U.S. Pat. No. 5,028,191, which is incorporated herein by reference in its entirety. Other suitable self-locking devices are available as Long-Lok® Fasteners Dyna-Thred II, which are commercially available from the Long-Lok Fasteners Corporation of Cincinnati, Ohio. In these fasteners, the inside diameter of the thread is dilated to expand the periphery of the thread. This technique forms a close tolerance hole axially into the threaded end of the fastener which produces a highly reliable self-locking connection. Other self locking mechanisms do not require a locking pin and rely on irregular thread geometry, such as the Spriralock™ fasteners available from the Spiralock Corp of Madison Heights, Mich. and the A-Lock™ fasteners available from a Shap, Inc. of Hackettstown, N.J.

Using a two-part mechanical fasteners, such as the threaded fasteners described above, to attach hosels to the club head minimizes the need for bonding the hosel to the club head body with the use of an adhesive. Since golf clubs are commonly reshafted, the hosel tube is typically heated to as high as 500° F. to break the adhesive bond between the shaft and hosel. The heat introduced to the golf club head to remove the shaft also damages the hosel/body bond. Using threaded fasteners without adhesives eliminates the need for heat and the potential damage to the hosel/body bond. Hosel sets in accordance with the present invention lock the hosel tube in place, allowing for reshafting without having to break the bond between the body and hosel tube.

Tests were run to determine the amount of torque required to install the hosel and the amount of torque required to remove the hosel. A threaded hosel with a locking pin required 75 in-lb to remove and 175 in-lb to remove. The threaded hosel with locking pin and Loctite 2760 Threadlocker adhesive available from the Henkel Loctite Corporation of Rocky Hill, Conn., required about 50-75 in-lb to install and about 575 in-lb to remove. A threaded hosel with only Loctite 2760 required less than about 50 in-lb to install and about 575 in-lb to remove. A threaded hosel with Loctite 2760 and a locking pin heated to 500° F. could not even be removed with 525 in-lb of force.

In one embodiment, each hosel in the hosel set is similar in shape and arrangement, varying only in length. Alternatively, each hosel can vary significantly in look, profile, thickness and/or length as long as the hosel can accommodate cavity 26. In addition, each hosel can be constructed from the same material or from a different material. Suitable materials include, but are not limited to, aluminum. In addition, although illustrated as substantially straight cylinders, each hosel could be varied in shaped and can include pre-defined bends or curves that impart a desired angle between the shaft and the club head. In one embodiment, each hosel is arranged in a shape that imparts a unique lie angle in the golf club head. In another embodiment, each hosel is arranged in a shape that imparts a unique face angle in the golf club head. In addition to providing a predetermined curvature in the hosel, each hosel can be constructed to be bendable. Therefore, the curvature of the hosel and hence the angle between the shaft and the golf club head can be customized after the hosel is inserted into the cavity.

Figure 10:
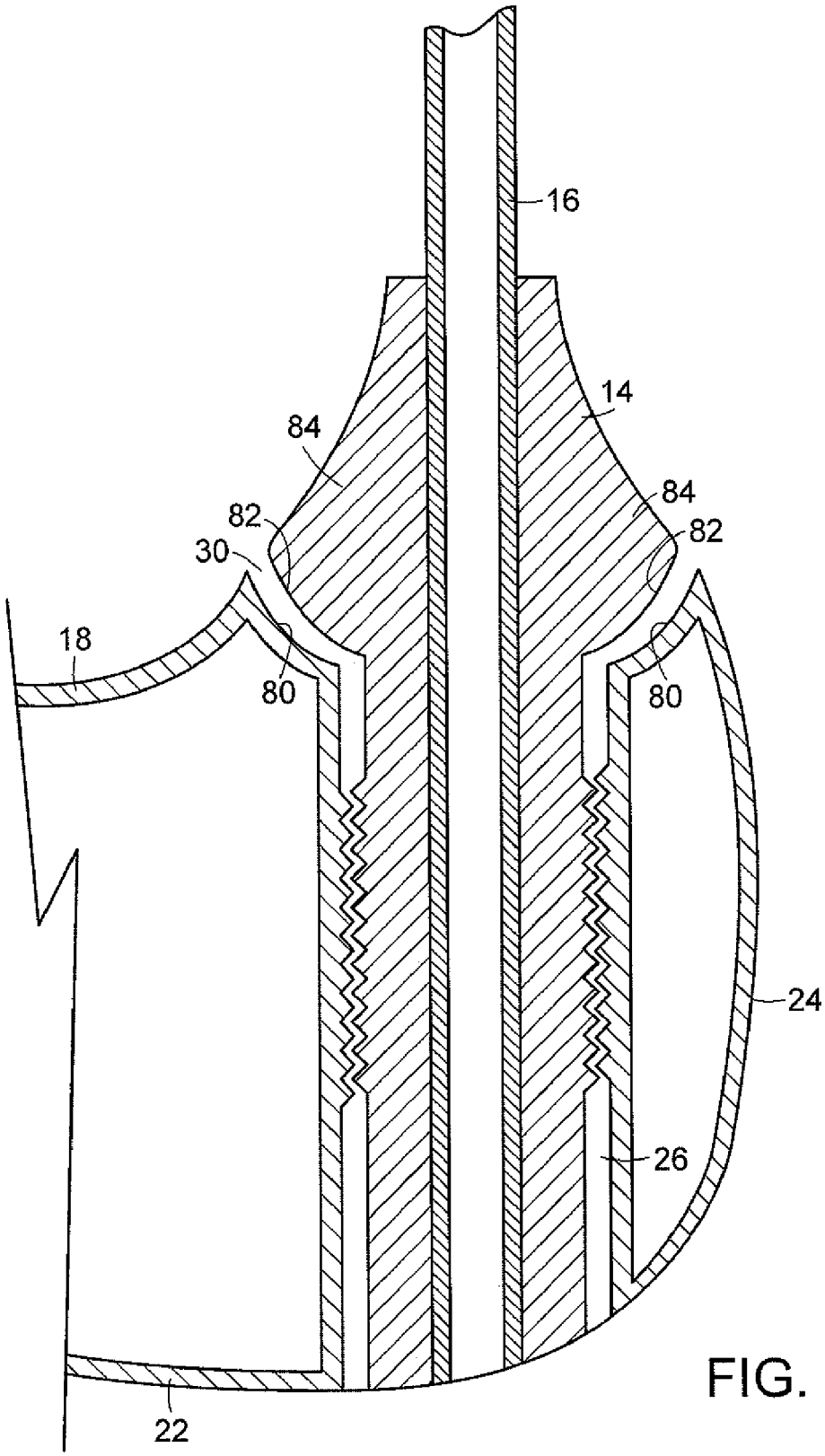
FIG. 10 is a cross-sectional view of an embodiment of a hosel and club head with mating surfaces for bending in accordance with the present invention.
Figure 11:
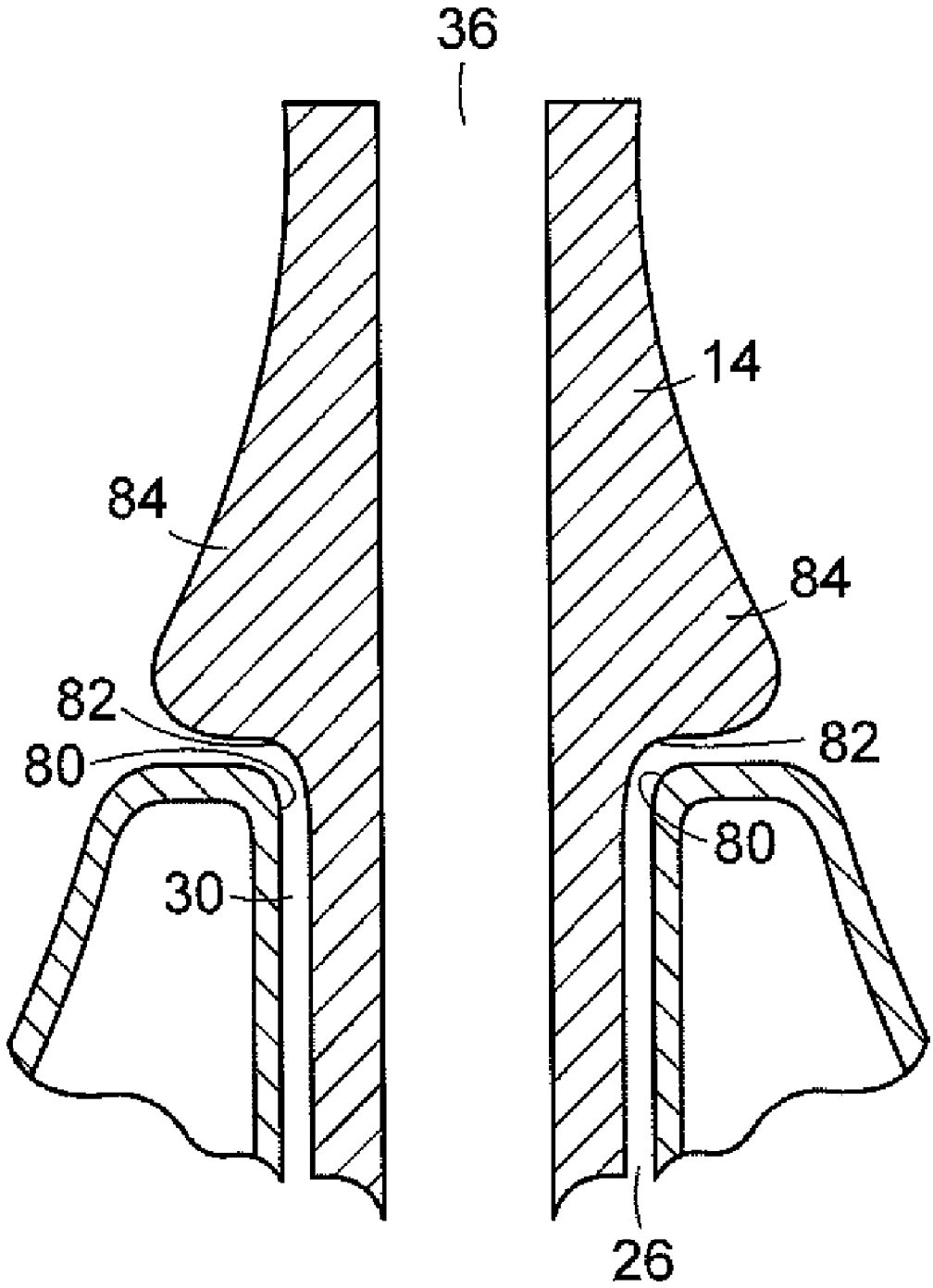
FIG. 11 is a cross-sectional view of another embodiment of a hosel and club head with mating surfaces for bending in accordance with the present invention.

As shown in FIG. 9, for example, hosel 14 generally has a square shoulder. This square shoulder may create binding and gapping between the hosel and the golf club head when the hosel is bent upon impact with golf balls after being installed to the club head. Therefore, in one embodiment the interface between each hosel and the golf club head is modified to facilitate or allow bending and to minimize binding and gapping. In one embodiment as illustrated in FIGS. 10 and 11, cavity 26 includes opening 30 to facilitate insertion of hosel 14 into cavity 26. Opening 30 includes first contour 80 and each hosel 14 includes second contour 82 disposed on hosel 14 at a location adjacent opening 30 when hosel 14 is inserted into cavity 26. Second contour 82 is shaped to compliment first contour 80 such that when hosel 14 is disposed within cavity 26 and bent, second contour 82 moves with respect to the first contour 80 to reduce gapping between the golf club head and the hosel as a result of the bending of the shaft. In one embodiment as illustrated in FIG. 10, first contour 80 is a concave contour, and second contour 82 is a convex contour. In another embodiment as illustrated in FIG. 11, first contour 80 is a convex radius, and second contour 82 is a concave radius. In one embodiment, each hosel 14 also includes protrusion 84 adjacent the concave radius or convex radius to provide a smooth surface transition from the hosel to the golf club head.

Concave/convex surfaces 80 and 82 can be incorporated on hosels attached to golf club heads by threaded fasteners as shown in FIG. 11 or by adhesives. The bending of shaft 16 occurs proximately to the location where the hosels are attached to the golf club heads, for example near the top of the threads shown in FIG. 11. The bending of shaft 16 is limited by the gap between surfaces 80 and 82.

Golf clubs in accordance with exemplary embodiments of the present invention include a club head having a heel, a toe opposite the heel, a crown, a sole opposite the crown, a club face for impact engagement with a golf ball and a cavity disposed adjacent the heel and passing from the crown to the sole. The golf club also includes the hosel set of the present invention to attach the shaft of the golf club to the golf club head. The hosel set includes two or more of the interchangeable hosels as disclosed herein, and each hosel can include one or more of the features as disclosed herein including interchangeable hosel length with constant weight, mating surfaces for hosel bending and threaded fittings for hosel removal. Each hosel preferably has a reduced weight, and the reduced weight is moved in the club head to relocate the center of gravity of the club head to a more desirable location. In one embodiment, the reduced weight of each hosel is between about 6 grams and 14 grams.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A hosel set for a golf club, the hosel set comprising:

at least two hosels, each hosel comprising a unique and different length and substantially the same weight as any other hosel in the hosel set, wherein each hosel is capable of being inserted into a cavity in a golf club head and of being interchangeable with the other hosels within said cavity, wherein said hosel is adapted to receive a shaft and attaches said shaft to the golf club head, and wherein each said hosel is longitudinally straight from end to end.

2. The hosel set of claim 1, wherein each hosel comprises a different material.

3. The hosel set of claim 1, wherein at least at least one of the hosels comprises at least one opening on its side wall to reduce the weight of the hosel.

4. The hosel set of claim 1, wherein each hosel is attached to the golf club head by adhesive.

5. The hosel set of claim 1, wherein the unique length of each hosel is from about 0.5 inch to about 8 inches.

6. The hosel set of claim 1, wherein the cavity comprises a first part of a two-part mechanical fastener and each one of the hosels comprises a complimentary second part of the two-part mechanical fastener.

7. The hosel set of claim 6, wherein the two-part mechanical fastener comprises a threaded fastener.

8. The hosel set of claim 1, wherein each hosel is bendable.

9. The hosel set of claim 1, wherein:

said cavity comprises a first contour; and each hosel comprises a second contour, wherein after said hosel is inserted into said cavity the first contour is spaced apart from the second contour and wherein the second contour is shaped to compliment the first contour such that the second contour moves relative to the first contour to reduce gapping between the golf club head and the hosel as a result of the bending of the shaft.

10. The hosel set of claim 9, wherein the first contour comprises a concave contour and the second contour comprises a convex contour.

11. The hosel set of claim 9, wherein the first contour comprises a convex radius and the second contour comprises a concave radius.

12. The hosel set of claim 11, wherein each hosel further comprises a protrusion adjacent the concave radius to provide a smooth surface transition from the hosel to the golf club head.

13. The hosel set of claim 1, wherein each hosel in the set covers progressively more of the shaft of the club head.

14. The hosel set of claim 13, wherein the more of the shaft covered by the hosel in the set the stiffer the shaft at the interface between the shaft and the club head.

* * * * *